United States Patent [19]

Shaw

[11] 4,075,797

[45] Feb. 28, 1978

[54] SHELTER CONSTRUCTION

[75] Inventor: James E. Shaw, Crown Point, Ind.

[73] Assignee: White Advertising Company, Shelby, Ind.

[21] Appl. No.: 722,789

[22] Filed: Sep. 13, 1976

[51] Int. Cl.[2] ..... G09F 7/18; E04B 1/34

[52] U.S. Cl. ..... 52/36; 52/38; 52/74; 40/553; 40/132 R; 40/557

[58] Field of Search ..... 52/38, 28, 36, 234, 52/79, 65, 297, 282, 16, 73, 74; 40/130 R, 132 R

[56] References Cited

U.S. PATENT DOCUMENTS

| | | | |
|---|---|---|---|
| 1,756,849 | 4/1930 | Braastad | 52/28 X |
| 2,052,755 | 9/1936 | Duffy | 52/28 X |
| 3,102,365 | 9/1963 | Whitesell | 52/38 X |
| 3,107,864 | 10/1963 | Kinnear et al. | 52/28 X |
| 3,201,579 | 8/1965 | Harper | 52/28 X |
| 3,359,691 | 12/1967 | Sherron | 52/28 X |
| 3,377,754 | 4/1968 | Russell | 52/28 X |
| 3,466,777 | 9/1969 | Wistrand et al. | 52/38 X |
| 3,470,658 | 10/1969 | Orliac | 52/28 |
| 3,543,454 | 12/1970 | Danin | 52/28 X |
| 3,971,172 | 7/1976 | Gentil | 52/28 |

*Primary Examiner*—Price C. Faw, Jr.
*Assistant Examiner*—Robert C. Farber
*Attorney, Agent, or Firm*—McDougall, Hersh & Scott

[57] ABSTRACT

This invention relates to a shelter construction including a roof section and vertically disposed legs for supporting the roof section. A vertical wall extends between the legs and advertising material or the like is retained by the wall. The legs combined with horizontal supports provide a border for the wall, and transparent panels are utilized for retaining advertising material between the panels and the wall. The roof is provided by means of sheets which extend substantially horizontally and then downwardly and inwardly to provide enclosures along the roof edges. These enclosures house additional advertising material, and lighting is utilized within the enclosure for enhancing the display.

8 Claims, 6 Drawing Figures

SHELTER CONSTRUCTION

The invention relates to a shelter construction. The invention is particularly directed to a construction which is suited for use in association with transit operations, for example, a bus shelter.

In the construction of transit shelters of any type, it has been desirable, particularly in recent years, to minimize expense. In the course of minimizing expense, however, it usually happens that the shelters are either inadequate or deteriorate so that replacement is necessary.

Also for economical reasons, it is desirable to provide transit shelters which will serve as advertising displays. Such displays can generate revenue, however, prior systems lead to significant additional expense in order to accommodate displays. This is particularly true since vandalism is a problem, and some security must be provided for the displays in order to minimize replacement and maintenance costs.

It is a general object of this invention to provide an improved transit shelter.

It is a more specific object of this invention to provide a transit shelter which can be economically constructed but which is characterized by substantial sturdiness and durability whereby replacement and maintenance costs are kept to a minimum.

It is a still further object of this invention to provide a transit shelter construction which includes means for displaying advertising material and the like.

It is an additional object of this invention to provide a transit shelter construction of the type described wherein the advertising material can be effectively displayed without undue cost and in a secure fashion.

These and other objects of this invention will appear hereinafter and for purposes of illustration, but not of limitation, specific embodiments of the invention are shown in the accompanying drawings in which.

Figure 1:
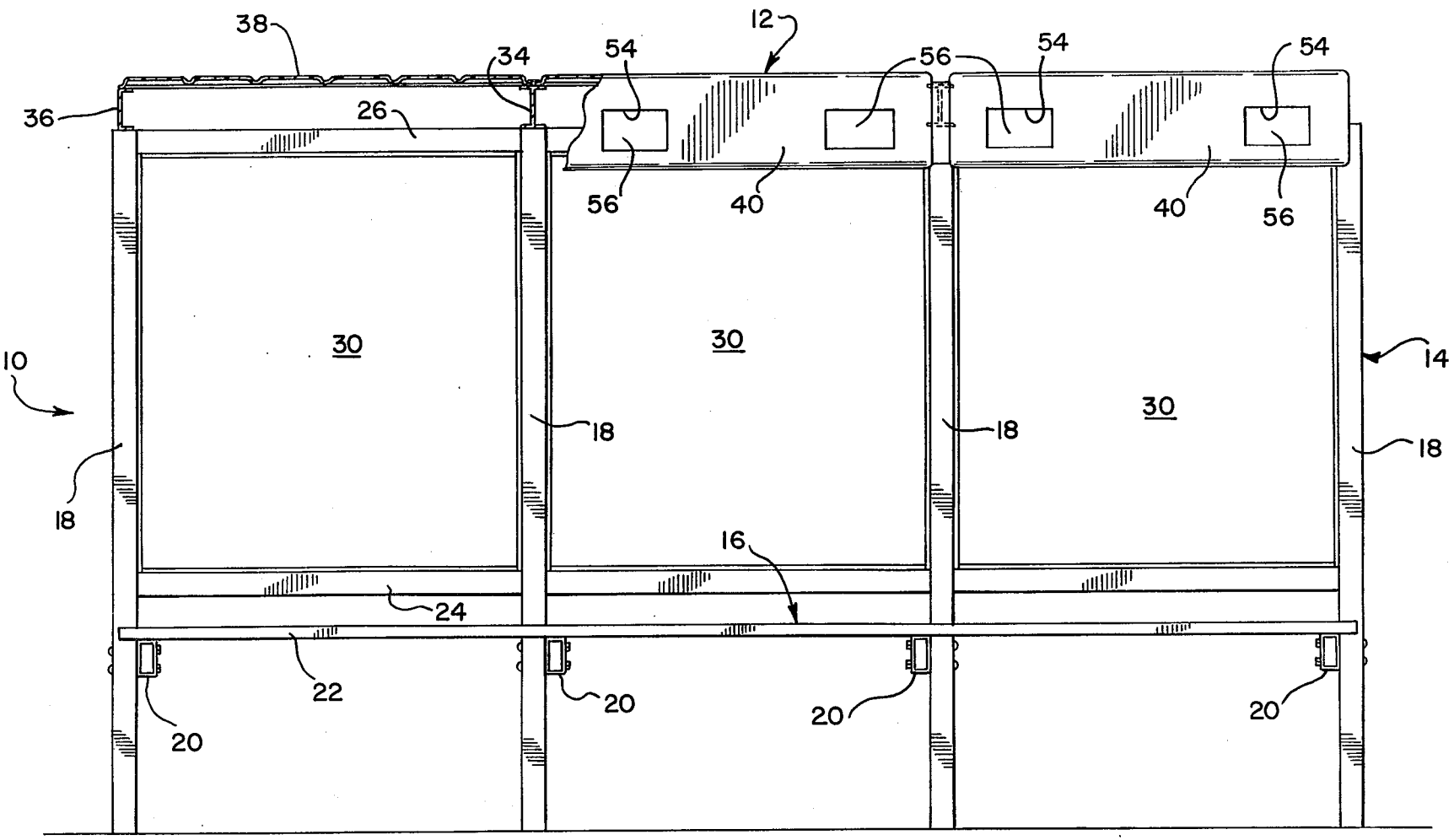
FIG. 1 is a vertical, elevational view, partly cut away, of a transit shelter construction.
Figure 2:
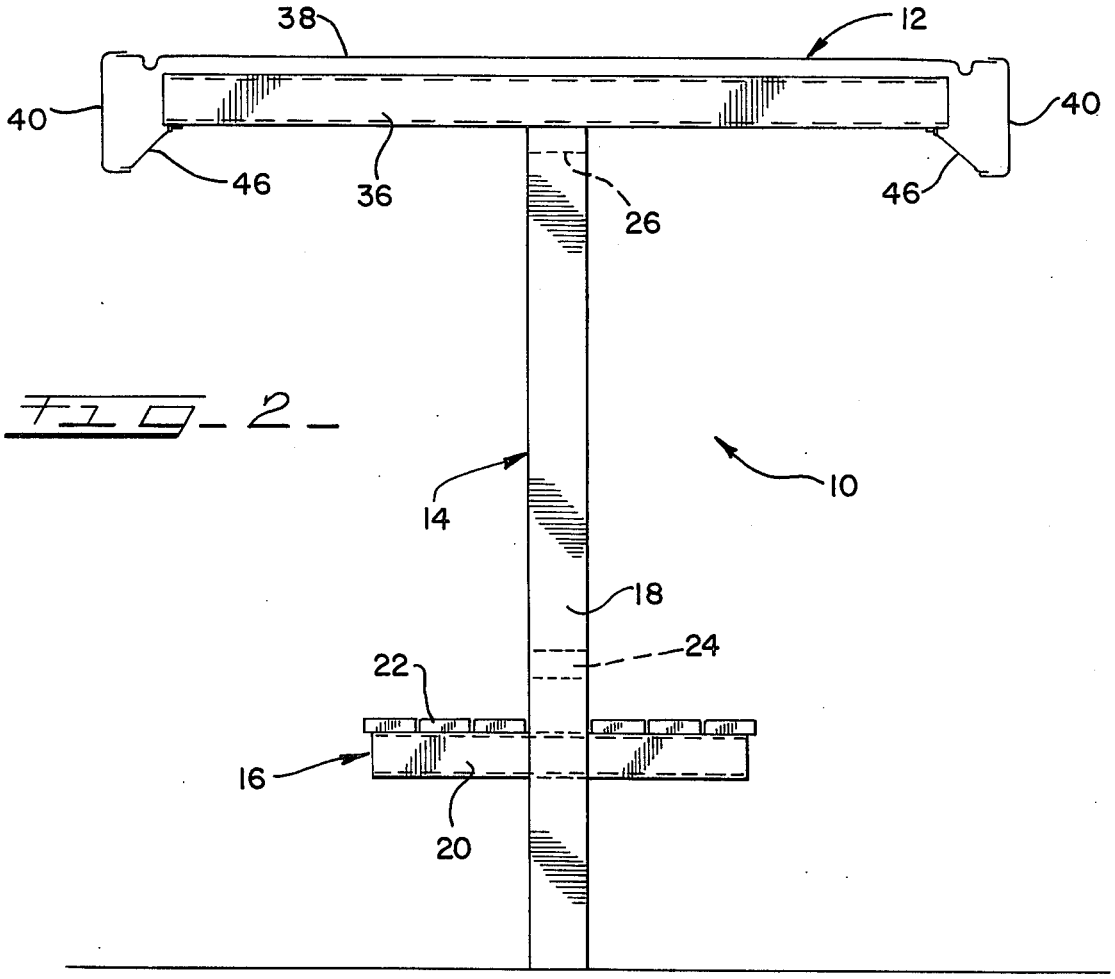
FIG. 2 is an end elevational view of the shelter construction.

The shelter construction of this invention generally comprises a roof section supported by vertically disposed legs. A vertical wall is positioned between the legs, and the construction is designed so that advertising material or the like can be displayed on the vertical wall and on the roof section.

The specific display construction of the invention involves the utilization of transparent panels releasably supported over the surfaces of the vertical wall. Advertising material is disposed between the panels and the wall surfaces, and this combination is releasably supported by stop means extending around the edges of the panels. The stop means secure the panels in position; however, they are designed so that displays can be changed from time-to-time.

The roof section of the shelter is designed so that covering sheets which provide the protection from the elements also serve as means for providing additional displays. Specifically, the roof sections extend substantially horizontally, and, at their outer edges, extensions are provided which extend downwardly and inwardly relative to supporting beams. With this arrangement, the roof section provides enclosures for lights so that the area will be lighted. In addition, display panels are incorporated into the covering sheets in the area of the downwardly extending portions so that additional displays, and particularly lighted displays, are available.

The particular means for building the construction comprise vertically and horizontally disposed tubular members of rectangular cross section. These members serve plural functions since they provide the vertical legs, the borders for the walls and panels, and the supports for the roof covering sheets. In addition, the tubular members provide support for the conventional bench means generally associated with such shelters. By utilizing the tubular members in this fashion, a strong yet economical shelter is achieved, and the display aspects are readily associated therewith.

The accompanying drawings illustrate a shelter construction 10 including a roof section 12, a vertically disposed supporting section 14 and a bench 16. The supporting section 14 includes a plurality of vertically disposed rectangular tubular members 18, the lower ends of which serve as legs for the construction. Horizontal tubular members 20 of rectangular cross section are bolted to the tubular members 18 and extend outwardly on either side thereof. These members 20 serve as supports for planks 22 which provide the bench 16.

The vertical tubular members 18 are interconnected by means of additional horizontal tubular members 24 and 26. The tubular members 18, 24, and 26 define rectangular frames or borders for three vertical wall sections in the construction.

Figure 6:
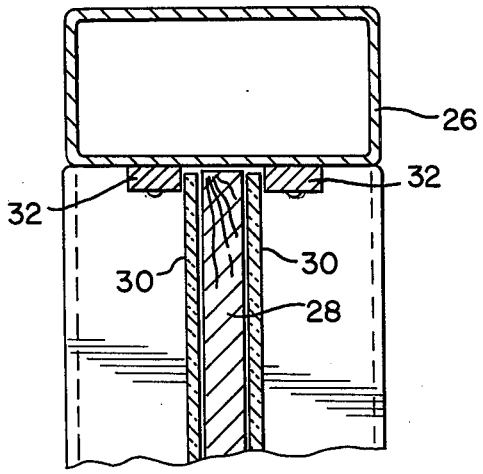

As best shown in FIG. 6, the wall sections comprise inner panels 28 which are preferably formed from wooden sheets of plywood. On opposite sides of the inner panels, there are provided transparent plastic panels 30 which may be formed of a polycarbonate material such as sold under the trademark LEXAN by the General Electric Company.

Each of the tubular members 18, 24, and 26 defines an inner wall, and a pair of bars 32 are mounted in spaced apart relationship on each of these inner walls. As shown in FIG. 6, the edges of the panels 28 and 30 are received between these bars whereby the bars retain the panels in assembled relationship. The bars 32 are releasably fastened to the surfaces of the tubular members, and a vandal-proof type screw is preferably utilized for this purpose. Such screws may include a square recess in their head or some other design which requires something other than an ordinary tool for turning the screws. This helps to minimize tampering with the displays associated with the wall sections.

The upper tubular members 26 also support beams 34 and 36. The beams 34 comprise I-beams which extend outwardly on each side of the tubular members 26. The beams 36 comprise channels which also extend outwardly on opposite sides of the tubular members.

A plurality of covering sheets 38, for example sheets of glass fibers, are supported by the beams 34 and 36. Thus, these sheets span the openings between the beams 34 and 36 so that a complete covering for the shelter is achieved.

Figure 4:
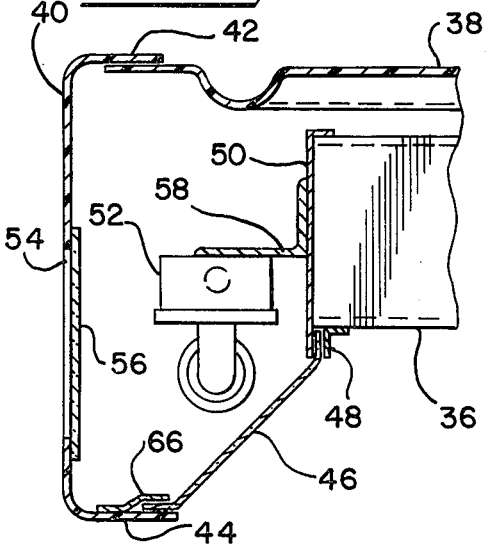
FIG. 4 is an enlarged fragmentary cross-sectional view illustrating structural details of enclosure means utilized in the construction.
Figure 3:
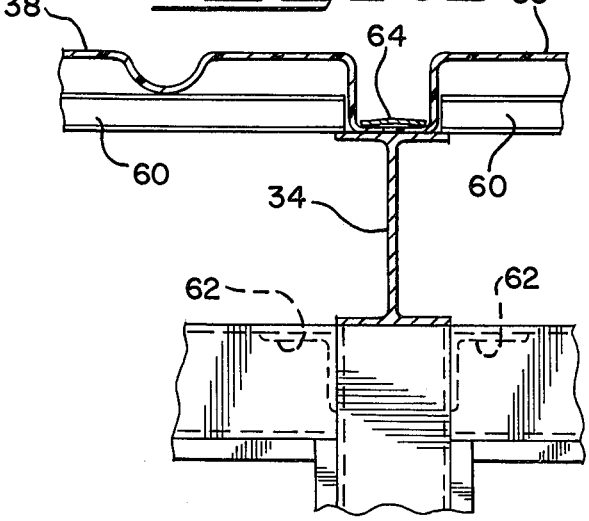
FIG. 3 is an enlarged fragmentary cross-sectional view illustrating structural details.
Figure 5:
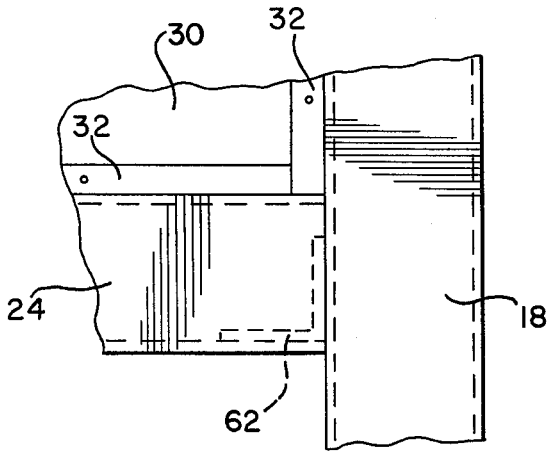
FIG. 5 is an enlarged fragmentary, cross-sectional view illustrating advertising retaining means utilized in the construction; and, FIG. 6 is an enlarged fragmentary, cross-sectional view further illustrating the retaining means utilized.

As best shown in FIGS 3 and 4, extensions 40 are attached to the sheets 38, these extensions extending downwardly and inwardly of the construction. The extensions may also be formed of glass fibers, and means are provided for connecting these extensions to the beams 34 and 36 so that enclosures are provided.

Referring to the particular structure shown in FIGS. 3 and 4, the extensions 40 are attached at 42 to the edges of sheets 38 and suitable fasteners, such as heavy staples or rivets, may be utilized for this purpose. The extensions illustrated are channel-shaped so that a lower return portion 44 is provided. This return portion serves as a means for attaching a transparent sheet 46, this sheet in turn extending to the beam 36. An angle 48 carried by the tubular member coupled with a baffle sheet 50 provide a recess for receiving the end of the sheet 46.

The angle members 48 and baffle sheets 50 extend between beams 36 and 34. The baffle 50 and sheet 46 are at least co-extensive with the extensions 40 so that complete enclosures are provided along the upper side edge of the construction.

As shown in FIG. 4, a lighting fixture 52 is included within this enclosure. Light from this fixture will pass through the sheet 46 for maintaining the shelter in a lighted area. As illustrated, an angle member 58 is attached to baffle sheet 50 for purposes of mounting the lighting fixture 52.

The extensions 40 may also define openings as shown at 54. A back-up panel 56 is associated with each such opening. In the preferred form of the invention, the extensions 40 comprise an opaque material. The panels 56, on the other hand, may be transparent or translucent so that these areas of the shelter become useful for displaying additonal advertising. In this connection, the term "advertising" is intended to include information of all type, for example, information identifying the location of the shelter, schedules of transit vehicles, etc.

Channel shaped supports 60 extend between the I-beams 34 and the channel members 36 for purposes of supporting the glass fiber supports 38. These sheets 60 are preferably welded to the respective beams.

Welding is also preferably employed for attaching the beams 34 and 36 to the vertical legs 18. The horizontal legs 24 and 26 are also preferably welded to the vertical beams, and angle members 62 may be employed for facilitating this operation.

The construction of the shelter insures complete sealing against rain and snow. In this connection, a retainer band 64 or the like may be employed for spanning the gap between edges of adjacent sheets 38 (FIG. 3).

As indicated, the structure described is made up of parts of relatively simple design whereby manufacturing and assembly costs are minimized. In addition, the simplified nature of the design does not result in a sacrifice of strength or durability since the use of the tubular supporting members and associated beams provide an exceptionally strong arrangement. The design of the construction is also such that the shelter will significantly protect against exposure to the elements while also confining those portions of the shelter which are susceptible to damage as by vandalism.

In the use of the construction, the bar members 32 on one side of the shelter are removed and advertising material, for example posters or the like, is placed in position between each surface of the panel 28 and the adjacent transparent panel 30. This assembly is then located in position, and the bars on one side replaced with the result that advertising material appears on both sides of the shelter even though the stop bars are removed on only one side. This provides a secure arrangement in addition to simplifying future changes.

Concerning the upper portion of the shelter, access is readily achieved through the sheets 46. In the embodiment illustrated, these sheets are retained at one end by means of clips 66, and at the other end in the opening defined between the angle member 48 and baffle plate 50. Any suitable removable fasteners may be located at this position so that only removal of fasteners from one end would be required to gain access to the interior of the enclosure. It is contemplated, however, that additional fasteners be employed for security purposes in the area of the clips 66.

Access to the interior of the enclosures will permit changing of panels 56, replacement of lights, and other maintenance. It is also contemplated that the sheets 46 be formed of a lens type material to provide diffused lighting for the shelter area. This material is satisfactory for serving as a barrier to entry into the enclosures.

It will be understood that various changes and modifications may be made in the above described application without departing from the spirit of the invention particularly as defined in the following claims.

That which is claimed is:

1. In a shelter construction including a roof section, vertically disposed legs for supporting the roof section, and a vertical wall extending between said legs, said legs comprising vertical tubes having a rectangular cross section, horizontally disposed tubes having a rectangular cross section extending between said vertical tubes, said vertical and horizontal tubes defining a border or said wall, the improvement comprising display means for advertising material and the like associated with the construction, said display means including a pair of transparent panels, and means for releasibly supporting said panels on a surface of said wall, said advertising material comprising separate sheets disposed between said panels and the respective wall surfaces, said means for releasibly supporting the panels comprising stops extending into engagement with panel edges whereby the stops resist any attempt to remove said panel, the stops comprising pairs of spaced-apart bars positioned on the inside facing surfaces of said tubes, the edges of said wall being retained in the spaced defined between the respective pairs of bars, the panel edges and the edges of the advertising material also being located in said space between the wall edges and the bars whereby said bars operate as said stops, and means for removing the bars on one side of said wall, said panels, said wall and said advertising material being unattached to said tube surfaces whereby the panels, wall and advertising material can be released.

2. A construction in accordance with claim 1 wherein said roof section is supported by at least four vertically disposed legs, at least three vertical wall sections being positioned between said legs, and at least one panel associated with each wall section.

3. A construction in accordance with claim 1 including beams extending crosswise of horizontal tubes located adjacent the top of said vertical tubes, and covering sheets extending over said beams to provide said roof.

4. A construction in accordance with claim 3 including elongated enclosures extending around said roof, said enclosures defining an exterior facing extending substantially vertically to said roof.

5. A construction in accordance with claim 4 wherein said enclosures comprise extensions of said covering enclosures, said enclosures extending downwardly and inwardly to ends which are attached to said beams, and including panels associated with said enclosures for displaying advertising material and the like.

6. A construction in accordance with claim 5 wherein said enclosures are substantially opaque, cut-outs defined by these enclosures, said panels being positioned in said cut-outs.

7. A construction in accordance with claim 6 wherein said panels are light transmitting, and including lighting means positioned in said enclosures.

8. A construction in accordance with claim 7 including removably attached, light transmitting sheets on the underside of the enclosures, said light transmitting sheets serving to permit the entry of light from the enclosure into the shelter, and also providing access to the enclosure.

* * * * *